US006118258A

United States Patent [19]

Farine et al.

[11] Patent Number: 6,118,258

[45] **Date of Patent: *Sep. 12, 2000**

[54] ELECTRICAL APPARATUS SUPPLIED BY A PHOTO-VOLTAIC POWER SOURCE

[75] Inventors: Pierre-André Farine; Jean-Pierre Wattenhofer, both of Neuchâtel, Switzerland

[73] Assignee: Asulab SA, Bienne, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,220

[22] Filed: Dec. 17, 1997

[30] Foreign Application Priority Data

Jan. 9, 1997 [CH] Switzerland ..... 0033/97

[51] Int. Cl.[7] ..... G05F 1/10

[52] U.S. Cl. ..... 323/222; 368/64; 320/140

[58] Field of Search ..... 320/140, 141, 320/137; 368/64; 323/222

[56] References Cited

U.S. PATENT DOCUMENTS 4,882,717 11/1989 Hayakawa et al. ..... 368/64
5,747,967 5/1998 Muljadi et al. ..... 320/148

FOREIGN PATENT DOCUMENTS 0 293 045 11/1988 European Pat. Off. .
2 142 490 1/1985 United Kingdom .
2 158 274 11/1985 United Kingdom .

OTHER PUBLICATIONS

Patent Abstracts of Japan vol. 096, No. 008, Aug. 30, 1996 & JP 08 107669 A (Sharp Corp).

*Primary Examiner*—Shawn Riley
*Attorney, Agent, or Firm*—Griffin, Butler, Whisenhunt & Szipl, LLP

[57] ABSTRACT

An autonomous low power consumption electrical apparatus that has a supply device (8) comprising a single photo-voltaic cell, an electrical accumulator (7), and a voltage booster (10, 11, TR1, TR3) connected between the power source (9) and the accumulator for charging the accumulator. The voltage booster is controlled by a pulse signal having a predetermined frequency. To allow the apparatus to start when the accumulator is completely discharged, the pulse signal can be generated, at least temporarily, by an oscillator that can operate at a very low voltage, that is, the voltage of the single photo-voltaic cell. When the apparatus is a timepiece, the oscillator (2) can be replaced by the oscillator of the time-keeping circuit (1) of the timepiece as soon as the accumulator (9) is sufficiently charged.

20 Claims, 1 Drawing Sheet

ELECTRICAL APPARATUS SUPPLIED BY A PHOTO-VOLTAIC POWER SOURCE

Figure 1:
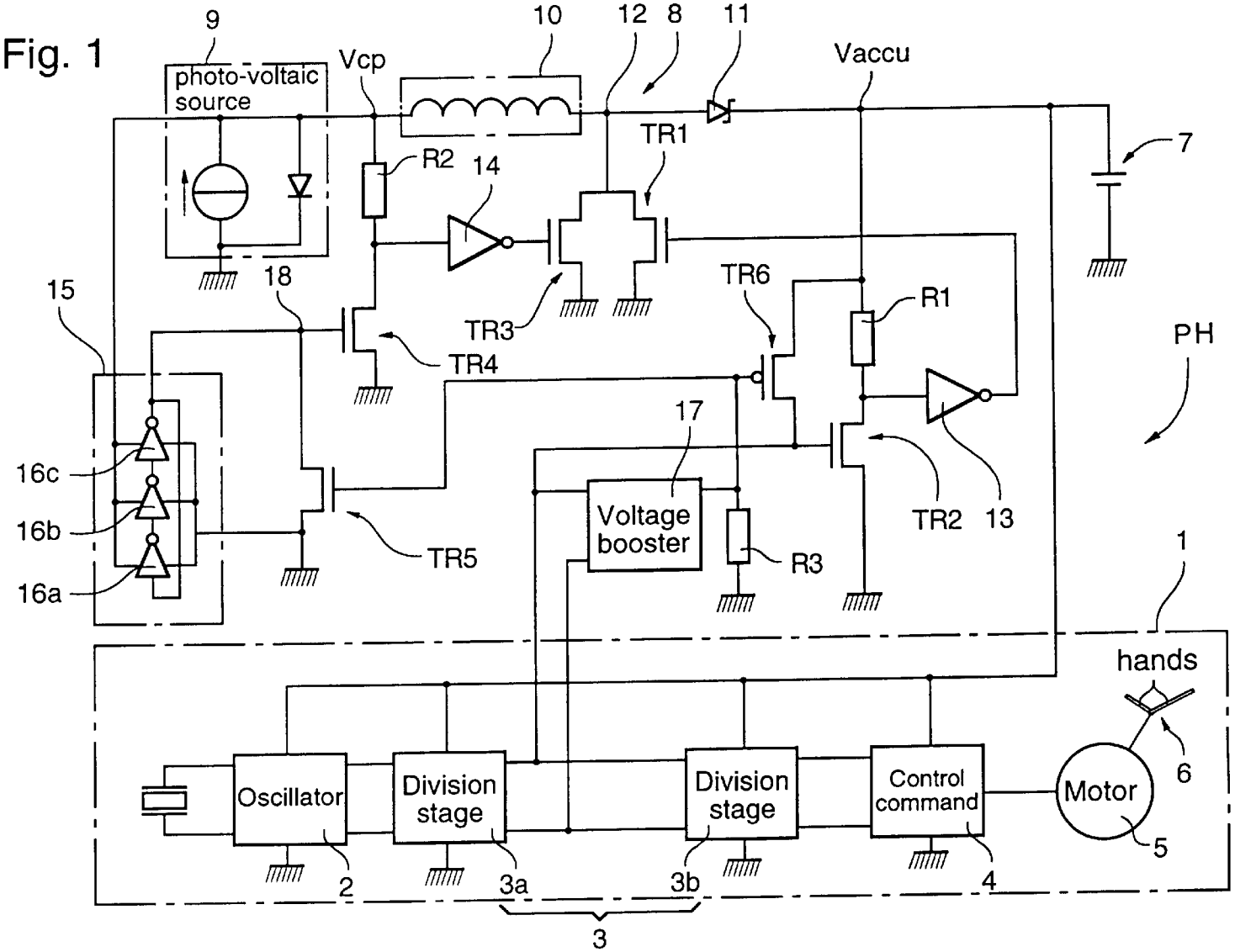

The present invention concerns an autonomous low power consumption electrical apparatus having a supply device comprising a power source operating by photo-voltaic conversion, an electrical accumulator and a voltage booster connected between the power source and the accumulator.

More precisely, the invention concerns the electric power supply, by means of a source using a photo-voltaic cell, of low power consuming devices such as timepieces, in particular a watch or an alarm clock, a pocket calculator, a miniature radio, an IR or radio remote control, a cordless telephone, a GPS receiver etc., and generally any apparatus with an autonomous power supply comprising an electrical power accumulator which is kept charged by means of a photo-electric power source.

The photo-voltaic sources or cells currently used for supplying these low power consuming devices, provide typically a voltage of approximately 0.3 to 0.5 V per element, whether they are of the semiconductor or photo-chemical type. Moreover, the electronic circuits require a supply voltage which cannot be less than 1 V, so that several of these cells are usually connected in series to assure the power supply of such circuits.

For aesthetic reasons and reasons of space requirement and price etc. (criteria which are particularly important in the horological technology), design solutions wherein a single photo-voltaic cell is sufficient to supply the apparatus are currently sought.

One can thus see that theoretically the low voltage supplied by a single photo-voltaic cell is incompatible with the voltage requirements of the current integrated circuits necessary to operate the apparatus of the above mentioned type.

To remedy this incompatibility, the applicant of the present application has already proposed (see patent application No PCT/CH97/00052 of Feb. 17, 1997) to provide the apparatus in question with a circuit by which the accumulator is charged via a voltage booster from a single photo-voltaic cell, the voltage booster being, for example, of the chopper-amplifier type.

The accumulator can be of any type currently available on the market, such as chemical accumulators, preferably lithium ion accumulators, and electrochemical capacitors, in particular those usually referred to as "supercapacitors" or "supercap".

The circuit described in the above mentioned document is able to keep the charge of the accumulator at a voltage sufficient for the electronic circuit used, while being able to operate with a single solar cell supplying a voltage of only 0.3 V to 0.5 V.

A particular problem, which arises for apparatus supplied by a set comprising a photo-voltaic cell, an accumulator, and a voltage booster resides in the fact that the apparatus may be left in total darkness for a long period of time. If the apparatus keeps operating in the dark, which may be the case for a timepiece for example, the charge of the accumulator is consumed without being renewed, so that the apparatus will stop operating at a given time, the accumulator having only a residual charge which is too low to supply the required voltage.

However, this residual accumulator charge will also be lost by self-discharge so that, if the period of darkness continues, the accumulator voltage may reach zero value.

If the user subsequently takes the apparatus out of the darkness, the cell will again supply energy, but only at its own voltage of at most 0.5 V. Since the components vital for the operation of the apparatus and in particular those responsible for controlling the voltage booster, cannot operate at such a supply voltage, the apparatus will no longer be able to start and if not thrown away, must at least be sent to a workshop for the accumulator to be charged by an external charging device.

In order to overcome this drawback, the aforecited Patent Application proposes to block the energy consuming circuits of the apparatus so that the accumulator always keeps a minimum of between 10% and 20% of its charge. In this way, if the apparatus is taken out of darkness, it will start without difficulty with the energy preserved in the accumulator, the latter being then able to be recharged via the photo-voltaic cell during normal operation.

However, supposing that the apparatus remains in darkness for a very long time, even the 10% to 20% of the accumulator charge will be lost eventually via self-discharging. A moment is then reached when the accumulator voltage will be in any event lower than the apparatus limit operating value so that the solution described in the aforecited Patent Document cannot resolve all possible cases concerning the starting of the apparatus.

An aim of the present invention is to provide an electric apparatus of the above mentioned type with which it is possible to start in all circumstances despite the use of a photo-voltaic source supplying a voltage lower than the minimum operation voltage of the components required to allow the apparatus to fulfil its function.

The invention thus concerns an autonomous low power consumption electrical apparatus having a supply device comprising a power source operating by photo-voltaic conversion, an electrical accumulator and a voltage booster connected between the power source and the accumulator for charging said accumulator, said source supplying an insufficient voltage to operate at least certain vital parts of the apparatus for it to fulfil its function, said voltage booster being controlled by a pulse signal having a predetermined frequency supplied by a first generator which is connected thereto, characterised in that said first pulse signal generator comprises an oscillator arranged so as to operate at a voltage equal to or less than the voltage supplied by said photo-voltaic source.

As a result of these features, the apparatus is able to start even if the accumulator is completely discharged since the oscillator required to control the voltage booster will operate as soon as the apparatus is placed in an environment where the lighting is sufficiently strong for the photo-voltaic power source to generate its supply voltage.

Other features and advantages of the present invention will become clear from the following description which is given solely by way of example, and which will be made with the aid of the attached drawing in which FIG. 1 shows an example of a diagram of an autonomous low power consumption electrical apparatus, more precisely a timepiece such as a watch or an alarm clock.

According to the embodiment shown in FIG. 1 the invention is applied to a timepiece PH. It will be noted that this is only an example of application of the invention, the low power consumption device for which the invention is intended being able to be any other apparatus having to operate autonomously by means of a photo-voltaic power source charging an accumulator.

Timepiece PH includes in a conventional manner, a time-keeping circuit 1 generally designated by a dot and dash line rectangle in FIG. 1. In a conventional manner, this circuit includes a quartz oscillator 2, preferably at 32768 Hz, a divider 3 represented here by two division stages 3*a* and 3*b* for dividing the frequency of oscillator 2 until a pulse signal is obtained, for example of 1 Hz. This pulse signal is applied to a control circuit 4 of a stepping motor 5 intended to drive a set of hands 6.

Timepiece PH is supplied by means of an accumulator 7 formed for example of a lithium ion accumulator or a large capacitor and more particularly by a component which watch and clockmakers call a "supercapacitor" or "supercap". The voltage present across the terminals of this accumulator 7 is designated $V_{accu}$.

Accumulator 7 forms part of a supply device generally designated by the reference 8. This supply device 8 also includes a photo-voltaic cell 9 formed for example of a single element supplying a voltage $V_{cp}$ ranging between 0.3V and 0.5V, and preferably of 0.4V. Any type of photo-voltaic cell may be used, of the semi-conductor or photo-chemical type.

A voltage booster including in series an inductor 10 and a Schottky diode 11 is mounted between photo-voltaic cell 9 and accumulator 7. In an advantageous manner, the coil of stepping motor 5 may be used as inductor 10.

Node 12 between inductor 10 and Schottky diode 11 is connected to the source-drain path of a first switching transistor TR1 which brings this connecting node alternately at the voltage of accumulator 7 and at ground at a frequency which is that of a control pulse signal applied to the gate of this transistor TR1. As a result of this operation, due to the presence of inductor 10, node 12 is brought to a much higher voltage than voltage $V_{cp}$ supplied by cell 9, which is sufficient to charge accumulator 7.

The gate of transistor TR1 is connected via an inverter 13 to the node between a resistor R1 and the source-drain path of a signal-shaping transistor TR2, the series connection of these two components being connected between the positive terminal of accumulator 7 and the ground. The gate of transistor TR2 is connected to the output of divider stage 3*a* of time-keeping circuit 1, this stage providing a signal at frequency 8192 Hz in the example described here.

Thus, when accumulator 7 is charged and supplies a sufficient voltage to supply the vital components of time-keeping circuit 1, and in particular oscillator 2 and divider stage 3*a*, switching transistor TR1 is alternatively conducting and non-conducting to the frequency of the output signal of divider stage 3*a*. If, simultaneously, timepiece PH is exposed to the light, this alternating conduction state of transistor TR1 causes the multiplication of voltage $V_{cp}$ supplied by the photo-voltaic cell, so that the charge of accumulator 7 is constantly renewed.

According to the invention, charging device 8 further includes a second switching transistor TR3 whose source-drain path is mounted in parallel to that of transistor TR1. The gate of this transistor TR3 is connected via an inverter 14 to the node situated between a resistor R2 and a second signal-shaping transistor TR4, the series connection of these two components being connected between the positive terminal of cell 9 ($V_{cp}$) and the ground.

The gate of signal-shaping transistor TR4 is connected to the output of an auxiliary oscillator 15 supplying at its output 18 a signal whose frequency is preferably close or equal to that at which the control signal appears at the output of divider stage 3*a*. Oscillator 15 is designed so that it can operate with a very low supply voltage, i.e. of a value equal to or less than the voltage supplied by photo-voltaic cell 9. Such an oscillator may be designed in any appropriate manner, but its design is preferably that described in the European co-pending Patent Application No 97100261.3. It will be noted for the purposes of the present description that oscillator 15 may be made with three inverters 16*a*, 16*b* and 16*c* mounted in a ring and comprising MOS transistors operating within the field of low inversion and suitably biaising the tubs constituting the MOS transistors in the substrate.

It will be observed, in examining the assembly described hereinbefore, that the increase of the voltage supplied by photo-voltaic cell 9 may be achieved by changing the state of conduction, either of transistor TR1, or of transistor TR3, since they are both capable of bringing node 12 alternately to the ground and to a voltage composed of the sum of voltage $V_{accu}$ and the voltage at diode 11.

According to a particularly important aspect of the present invention, means are provided for allowing selective activation of switching transistors TR1 and TR3 as a function of a signal representing the activity of the power consuming device which in this case, is time-keeping circuit 1 of timepiece PH. In the example described, the activity signal is picked up at the output of divider stage 3*a* and evidences the operation of quartz oscillator 2. However, it will be understood that the activity signal could also be picked up elsewhere in the time-keeping circuit, for example at the output of control circuit 4, or after having been suitably adapted to allow control of switching transistors TR1 and TR3.

In the example described, oscillator 2 and divider stage 3*a* only show activity if their supply voltage is sufficient to make the components which form them operate. Typically, this voltage may be equal to or greater than 1V, although this voltage must not be considered as limiting the invention.

In order to adapt the activity signal, the output of divider stage 3*a* is connected to the input of a voltage booster 17 which may be formed by a circuit known under the name of its designer Dickson.

The output of voltage booster 17 is connected to ground via resistor R3, to the gate of a first selection transistor TR5 and to the gate of a second selection transistor TR6 which has an opposite type of conductivity to that of transistor TR5. In the example described, transistor TR5 is of the N type and transistor TR6 is of the P-type.

The drain-source path of transistor TR5 is connected between the ground and a node 18 which is connected to the output of oscillator 15 and to the gate of transistor TR4.

The drain-source path of transistor TR6 is connected between the gate of transistor TR2 and the positive terminal of accumulator 7.

The operation of the timepiece thus designed is described hereinafter.

It is assumed that the timepiece has been left in the dark for a period of time such that accumulator 7 is completely discharged, voltage $V_{accu}$ being close, or even equal to zero. It is also assumed that, in these circumstances, the user wishes to use the timepiece again and consequently takes it out of the dark. Since time-keeping circuit 1 has not been supplied, it supplies no activity signal, since oscillator 2 and divider stage 3*a* are incapable of operating. Voltage booster 17 does not supply any voltage on its output so that transistor TR6 is conducting preventing the control of transistor TR1, and transistor TR5 is non-conducting.

Since cell 9 is illuminated, it supplies energy with a voltage of a value between 0.3 and 0.5 V. At this voltage oscillator 15 is capable of operating and it is authorised to do so thanks to the blocking of transistor TR5. Consequently, transistors TR4 and TR3 are switched to the frequency of oscillator 15.

More precisely, when transistor TR3 is conducting, inductor 10 stores energy which is abruptly delivered with a voltage peak when transistor TR3 is blocked. The voltage peaks allow accumulator 7 to be charged at higher voltage than that supplied by sell 9. Transistor TR4 accompanied by inverter 14 acts as a buffer between the output of oscillator 15 and transistor TR3 which is relatively large and thus has a significant input capacitance. Thus, the accumulator can be charged.

As soon as accumulator 7 is sufficiently charged to supply a suitable supply voltage to oscillator 2 and divider stage 3*a*, an activity signal appears at the output of this stage. The time-keeping circuit starts and voltage booster 17 supplies an output voltage.

This latter makes transistor TR 5 conducting, short-circuiting oscillator 15 which then stops operating. Conversely, transistor TR6 is made non-conducting which delivers the control of transistor TR1, via transistor TR2 and inverter 13. Thus, transistor TR1 is substituted for transistor TR3 and accumulator 7 may continue to be charged as long as the time-keeping circuit operates normally. It is thus understood that these transistors TR5 and TR6 operate as substitution control means.

Voltage booster 17 is desirable to obtain swift switching of transistors TR5 and TR6 as soon as oscillator 2 delivers an activity signal to divider stage 3*a*.

It will be noted that oscillator 2 begins to operate as soon as it detects a sufficient voltage across its supply terminals which causes the activity signal to appear. This means that the switching between the two oscillators 15 and 2 takes place independently of the design differences which may exist between the circuits of different timepieces. The value of minimum voltage $V_{accu}$ for the operation of oscillator 2 may thus be determined by each circuit individually according to the values of its own components.

According to an alternative embodiment which has not been shown in the drawing, it is possible to use oscillator 2 and divider stage 3*a* solely to control time-keeping circuit 1, oscillator 15 being responsible for permanently controlling the voltage booster. In this alternative embodiment, transistors TR1, TR2, TR5 and TR6. inverter 13, resistors R1 and R3 and voltage booster 17 may be omitted.

What is claimed is:

1. An autonomous low power consumption electrical apparatus capable of being connected to a load, this apparatus having a supply device comprising a power source operating by photo-voltaic conversion, an electrical accumulator connected to said load, and a voltage booster connected between said power source and said accumulator for charging said accumulator, said source supplying a voltage which is not sufficient for operating said load, said voltage booster being controlled by a pulse signal having a predetermined frequency supplied by a first generator when the voltage of the accumulator is not sufficient, said first generator being connected to said power source, wherein said first pulse signal generator comprises an oscillator directly connected to said power source and arranged so as to operate at a voltage equal to or less than the voltage supplied by said photo-voltaic source.

2. An apparatus according to claim 1, wherein said oscillator is a ring oscillator.

3. An apparatus according to claim 1, wherein said voltage booster comprises an inductor connected between said photo-voltaic source and the series connection of a diode and said accumulator and wherein the output of said oscillator is connected to first switching means capable of bringing the node between said diode and said inductor alternatively to a voltage level equal to the sum of the voltage of this accumulator and the voltage across the diode and to ground.

4. An apparatus according to claim 3, wherein said first switching means comprise a switching transistor whose source-drain path is connected between the ground and said node and whose gate is connected to the output of said oscillator via a shaping transistor for the signal supplied by the oscillator.

5. An apparatus according to claim 4, wherein an inverter is connected between said switching transistor and said shaping transistor.

6. An apparatus according to claim 3, wherein said load comprises second pulse signal generator means and wherein said apparatus further comprises: second switching means capable of bringing the node between said series connection and said inductor alternatively to said voltage level and to ground voltage level; activity signal generating means representative of the execution of said function by the apparatus; and substitution control means for, when said generating means generate said activity signal, connecting to said voltage booster said second pulse signal generating means instead of said oscillator.

7. An apparatus according to claim 6, wherein said second pulse signal generator means form said activity signal generating means.

8. An apparatus according to claim 6, wherein said substitution control means comprises a first control transistor capable of short-circuiting the output of said oscillator and a second transistor capable of activating said second switching means when said activity signal appears.

9. An apparatus according to claim 8, wherein said second switching means comprise a transistor whose source-drain path is connected between the ground and said node and whose gate is connected to receive the activity signal via a second transistor for shaping this signal.

10. An apparatus according to claim 9, wherein an inverter is connected between said switching transistor of said second switching means and said second shaping transistor.

11. An apparatus according to claim 8, wherein said first and second control transistors are connected to said activity signal generating means via voltage booster means.

12. An apparatus according to claims 6, wherein it comprises a time keeping circuit and wherein said second pulse signal generating means are formed by a quartz oscillator and possibly also by a part of the divider of said time keeping circuit.

13. An apparatus according to claim 1, wherein the power source is a single solar cell operating between 0.3V and 0.5V.

14. An autonomous low power consumption electrical apparatus capable of being connected to a load, said apparatus having a supply device comprising a power source operating between 0.3V and 0.5V by photo-voltaic conversion, said source supplying a voltage which is not sufficient for operating said load, an electrical accumulator connected to said load, and a voltage booster for charging said accumulator connected between the power source and the accumulator, the voltage booster being controlled by a pulse signal of predetermined frequency supplied by a first generator connected thereto, wherein the first pulse signal generator comprises an oscillator arranged so as to operate at a voltage equal to or less than the voltage supplied by the photo-voltaic source.

15. An autonomous low power consumption electrical apparatus capable of being connected to a load, said apparatus having a supply device comprising a power source constituted by a single solar cell, said source supplying a voltage which is not sufficient for operating said load, an electrical accumulator connected to said load, and a voltage booster for charging said accumulator connected between the power source and the accumulator, the voltage booster being controlled by a pulse signal of predetermined frequency supplied by a first generator connected thereto, wherein the first pulse signal generator comprises an oscillator arranged so as to operate at a voltage equal to or less than the voltage supplied by the photo-voltaic source.

16. An apparatus according to claim 14, wherein said voltage booster comprises an inductor connected between said photo-voltaic source and the series connection of a diode and said accumulator and wherein the output of said oscillator is connected to first switching means capable of bringing the node between said diode and said inductor alternatively to a voltage level equal to the sum of the voltage of this accumulator and the voltage across the diode and to ground.

17. An apparatus according to claim 15, wherein said voltage booster comprises an inductor connected between said photo-voltaic source and the series connection of a diode and said accumulator and wherein the output of said oscillator is connected to first switching means capable of bringing the node between said diode and said inductor alternatively to a voltage level equal to the sum of the voltage of this accumulator and the voltage across the diode and to ground.

18. An apparatus according to claim 14, wherein said load comprises second pulse signal generator means and wherein said apparatus further comprises: second switching means capable of bringing the node between said series connection and said inductor alternatively to said voltage level and to ground voltage level; activity signal generating means representative of the execution of said function by the apparatus; and substitution control means for, when said generating means generate said activity signal, connecting to said voltage booster said second pulse signal generating means instead of said oscillator.

19. An apparatus according to claim 15, wherein said load comprises second pulse signal generator means and wherein said apparatus further comprises: second switching means capable of bringing the node between said series connection and said inductor alternatively to said voltage level and to ground voltage level; activity signal generating means representative of the execution of said function by the apparatus; and substitution control means for, when said generating means generate said activity signal, connecting to said voltage booster said second pulse signal generating means instead of said oscillator.

20. An apparatus according to claim 15, wherein the power source is a single solar cell operating between 0.3V and 0.5V.

* * * * *